US011047153B2

(12) United States Patent
Necchi

(10) Patent No.: US 11,047,153 B2
(45) Date of Patent: Jun. 29, 2021

(54) ADJUSTABLE ANTI-THEFT CASE COMPRISING WITHDRAWAL-PREVENTING MEANS

(71) Applicant: Enneffe S.R.L., Valenza (IT)

(72) Inventor: Piero Necchi, Alessandria (IT)

(73) Assignee: Enneffe S.R.L., Valenza (IT)

( * ) Notice: Subject to any disclaimer, the term of this patent is extended or adjusted under 35 U.S.C. 154(b) by 216 days.

(21) Appl. No.: 16/360,231

(22) Filed: Mar. 21, 2019

(65) Prior Publication Data

US 2019/0301207 A1 Oct. 3, 2019

(30) Foreign Application Priority Data

Mar. 27, 2018 (IT) ..... IT102018000004004

(51) Int. Cl.
*E05B 73/00* (2006.01)

(52) U.S. Cl.
CPC ..... *E05B 73/0023* (2013.01); *E05B 73/0058* (2013.01)

(58) Field of Classification Search
CPC ..... E05B 73/0023; Y10T 70/5004; Y10T 70/5009; Y10T 70/8838; F41C 33/06
(Continued)

(56) References Cited

U.S. PATENT DOCUMENTS 5,483,905 A * 1/1996 Johansson ..... A47B 81/00 109/79

5,524,752 A * 6/1996 Mazzucchelli ..... A47F 7/0246 206/1.5

(Continued)

FOREIGN PATENT DOCUMENTS

FR 2914938 A1 * 10/2008 ..... E05B 73/0023
WO WO-2008142281 A1 * 11/2008 ..... E05B 73/0023

*Primary Examiner* — Eric Blount
(74) *Attorney, Agent, or Firm* — Macheledt Bales LLP; Jennifer L. Bales

(57) ABSTRACT

An adjustable anti-theft case (1) is described, of the type comprising item removal preventing means (2) from inside of the case (1) and comprising at least one side along its height (3) and one side along its depth (4, 44) which have a length substantially corresponding to or lower than the minimum length of the corresponding sides dell'item (2) of minimum sizes, at least one (3, 4, 44) of the sides (3, 4, 44) being made able to be elongated, through at least one extension (6, 46), over the minimum length, the side able to be elongated (3, 4, 44) being designed to be blocked in its elongation condition through the engagement between first engaging teeth (7) present on the extension (6, 46) and locking and unlocking means (14, 24) made of ferromagnetic material connected to the side able to be elongated (3, 4, 44) and projecting from its surface oriented towards the surface of the extension (6, 46), the side able to be elongated (3, 4, 44) being further designed to be unlocked from its elongation condition through the disengagement between the first engaging teeth (7) and the locking and unlocking means (14, 24) by means of a magnetic attraction force, the extension (6, 46) being equipped with at least one row of first engaging teeth (7) arranged next to a side end (15, 16, 55, 56) of the extension (6, 46), the locking and unlocking means (14, 24) being arranged next to at least one side end (25, 26, 65, 66) of the side able to be elongated (3, 4, 44).

15 Claims, 9 Drawing Sheets

(58) Field of Classification Search
USPC ..... 70/57.1, 63
See application file for complete search history.

(56) References Cited

U.S. PATENT DOCUMENTS

| | | | | |
|---|---|---|---|---|
| 5,613,607 | A * | 3/1997 | Kalmanides | B65D 75/366 206/467 |
| 5,768,922 | A * | 6/1998 | Lax | E05B 73/0023 206/387.1 |
| 5,779,039 | A * | 7/1998 | Ambrus | E05B 73/0023 206/1.5 |
| 5,791,079 | A * | 8/1998 | Mazzucchelli | A47F 5/0861 40/625 |
| 6,412,633 | B1 * | 7/2002 | Costa | E05B 73/0023 206/1.5 |
| 7,116,224 | B2 * | 10/2006 | Mickler | F41C 33/06 340/568.1 |
| 8,328,016 | B2 * | 12/2012 | Thornton | B65D 73/0092 206/465 |
| 8,464,563 | B2 * | 6/2013 | Perez | E05B 73/0023 70/57.1 |
| 8,807,335 | B2 * | 8/2014 | Nilsson | E05B 73/0023 206/308.2 |
| 8,833,115 | B2 * | 9/2014 | Nakasuji | E05B 73/0023 70/57.1 |
| 10,013,901 | B2 * | 7/2018 | Chapuis | G06Q 30/0623 |
| 10,472,879 | B1 * | 11/2019 | Galler | E05B 65/0075 |
| 2003/0041787 | A1 * | 3/2003 | Gerstenkorn | A47B 81/005 109/73 |
| 2005/0168114 | A1 * | 8/2005 | Zinn | A47F 3/005 312/138.1 |
| 2006/0137410 | A1 * | 6/2006 | Choi | E05B 73/0023 70/57.1 |
| 2012/0079858 | A1 * | 4/2012 | Perez | E05B 73/0023 70/57.1 |
| 2015/0371321 | A1 * | 12/2015 | Chapuis | G09F 3/208 705/27.1 |

* cited by examiner

ADJUSTABLE ANTI-THEFT CASE COMPRISING WITHDRAWAL-PREVENTING MEANS

BACKGROUND OF THE INVENTION

1) Field of the Invention

The present invention refers to an adjustable anti-theft case, in particular for containers for blades, perfumes, compact discs, musicassettes, videocassettes, books or the like, and of the type comprising withdrawal-preventing means of such items from inside the case, which can be activated and/or only de-activated by means of magnetic devices available only for service personnel, while inside the case, together with such items, anti-theft means are housed, in an inaccessible position, such as magnetic labels, radiofrequency emission labels or the like, cooperating with detecting barriers.

2) Background Art

Cases of this type are known, and have transparent walls to make the product contained therein visible. They are composed of boxes whose shape is complementary to the packaging shapes of the items which are inserted in the cases themselves, generally through an open head side, and they are equipped with withdrawal-preventing means which allow opening the container and withdrawing the package of the product therein, through the use of suitable and dedicated detaching devices of a magnetic type, available to the service personnel of a point of sale.

Such cases have proven efficient to avoid thefts of the items. However, they have the problem of not allowing a good visibility from outside of the product contained therein, due to the presence of the withdrawal-preventing means which are placed on a wall of the case.

Such withdrawal-preventing means are cumbersome, with respect to the case sizes, and are made on one of its walls, preventing the view of the product being sold contained therein.

Documents US-A1-2012/079858, FR-A1-2 862 999 and FR-A1-2 914 938 disclose prior art anti-theft cases.

SUMMARY OF THE INVENTION

Object of the present invention is solving the above prior art problems, by providing an adjustable anti-theft case, equipped with withdrawal-preventing means, which allows a total visibility of the product contained therein.

The above and other objects and advantages of the invention, as will result from the following description, are obtained with an adjustable anti-theft case as claimed in claim 1. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) can be made to what is described, without deparing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

With reference to the Figures, a preferred embodiment of the adjustable anti-theft case of the present invention is shown and described.

With reference to the Figures, the case 1 according to the present invention comprises a sector of case which extends next to an angular zone of the item 2 to be contained, whose package is composed of a box, substantially shaped as a relatively thin, rectangular parallelepiped. In this case, the item can be a package of razor blades, a perfume, a videocassette, a compact disc, a book or similar items.

Figure 3:
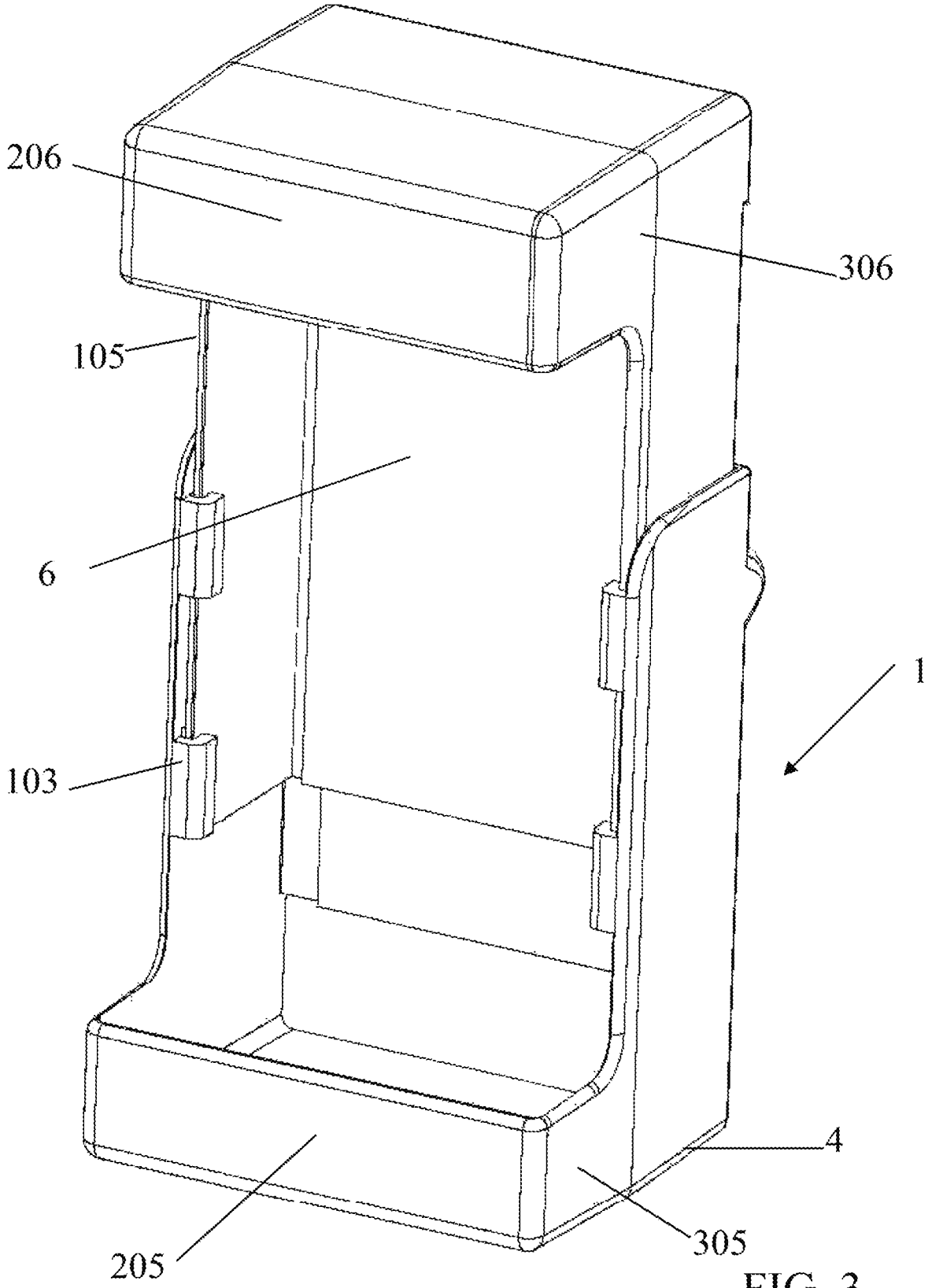
FIG. 3 is a front perspective view of the case of FIG. 2.
Figure 4:
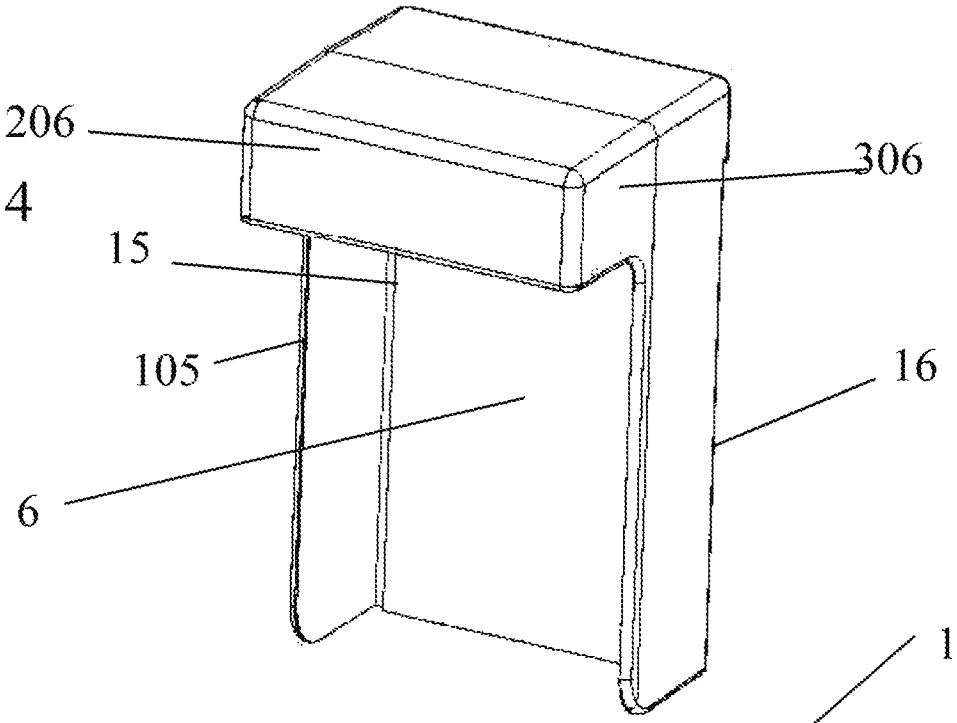
FIG. 4 is a perspective view similar to FIG. 3, which shows one of the two main parts of which the case is composed.
Figure 5:
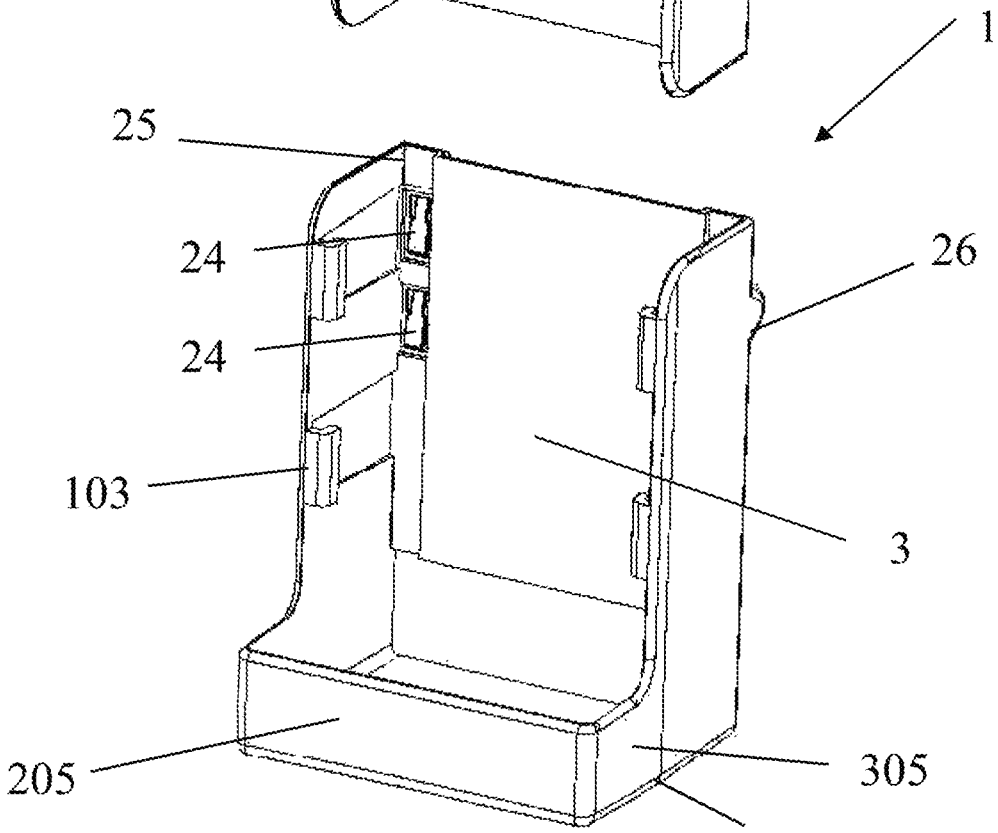
FIG. 5 is a perspective view similar to FIG. 3, which shows the other of the two main parts of which the case is composed.
Figure 6:
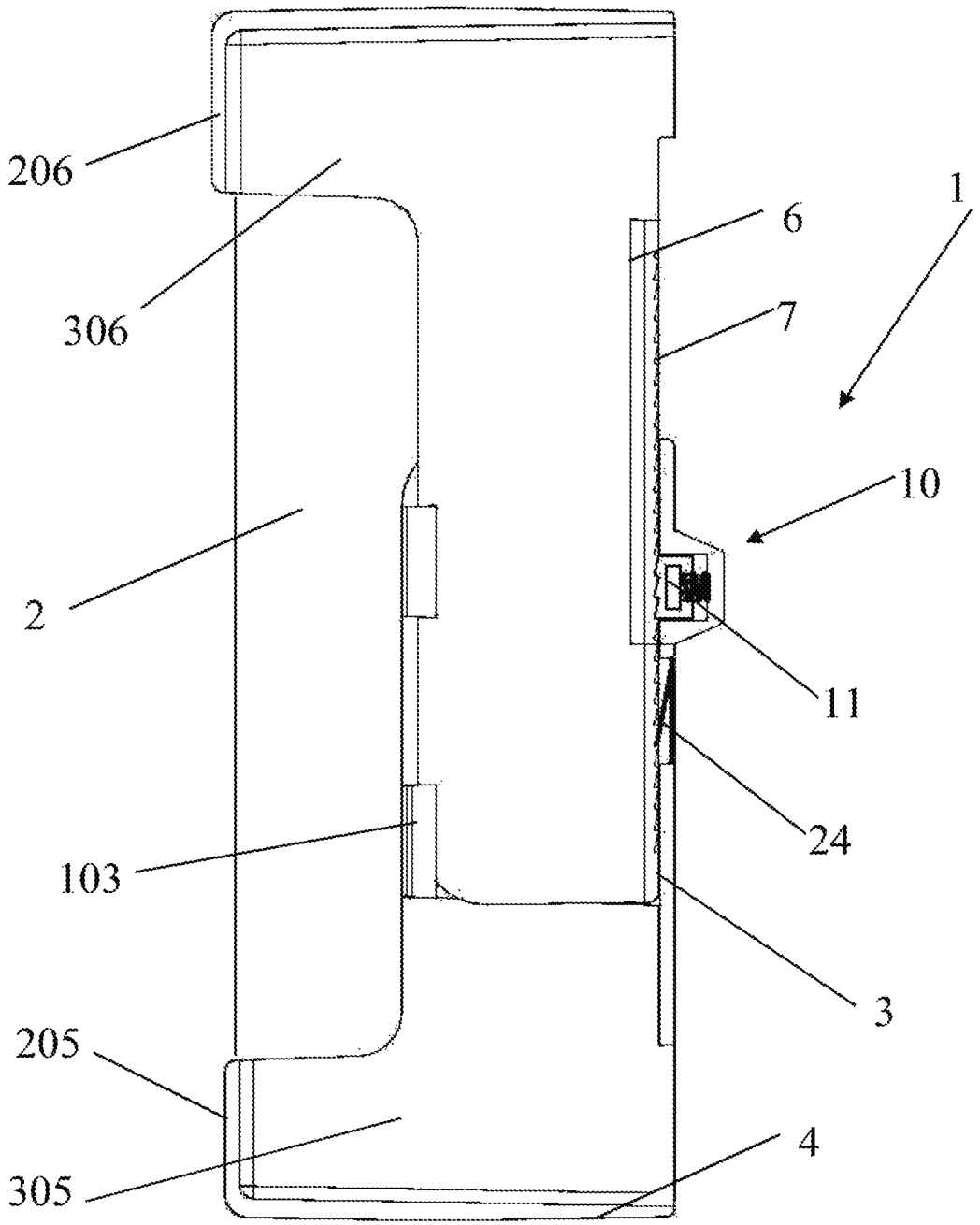
FIG. 6 is a side view of the case of FIG. 2.

The sector of case 1 has two opposite faces, and a side 101 which substantially mutually connects the free ends of a side along its height 3 and of a side along its depth 4, which enclose the corresponding angle. The side along its height 3 and the side along its depth 4 of the sector of case 1 have a length substantially equal or slightly lower than the length of the corresponding sides of the item 2 with minimum sizes. Along the side along its height 3, an extension 6 is assembled, sliding in its longitudinal direction. In particular, as better shown in FIGS. 3 to 5, the extension 6 engages a profiled sliding extension 105, for example a dovetail, in a complementary guide 103 made on the end of the side 101.

Preferably, the case 1 further comprises a sliding element on the extension 6 and a corresponding sliding element on the side 3, not shown in the Figures, wherein such sliding elements are mutually engaged to guarantee the sliding of the extension 6 with respect to the side 3.

At its free end, the extension 6 is connected to a side along its depth 44, in turn connected to a perpendicular transverse head wall 206 and to a section of longitudinal side wall 306; similarly, the side 3 is connected to the side along its depth 4, in turn connected to a perpendicular transverse head wall 205 and to a section of longitudinal side wall 305, everything connected in such a way as to form a housing seat of the angular zone of the packaging box 2 of the item.

In the embodiment shown, the extension 6 is equipped, preferably on its face oriented towards the corresponding side along its height 3, with at least one row of first engaging teeth 7 arranged next to a side end 15 of the extension 6; in a preferred way, the extension 6 is equipped with two rows of first engaging teeth 7 arranged next to two side ends 15, 16 opposite to the extension 6; preferably, a row of first engaging teeth 7 is arranged next to a first side end 15 of the extension 6, and a second row of first engaging teeth 7 is arranged next to a second side end 16 of the extension 6, opposite to the first, the rows of first engaging teeth 7 arranged next to a first side end 15 and to a second side end 16, which, in a preferred way, are mutually parallel. The first engaging teeth 7 of each row are mutually at the same distance and aligned along the sliding direction of the extension 6. They project over the surface of the extension 6 oriented towards the internal surface of the side along its height 3 of the sector of case 1. Such first teeth 7 are oriented in a complementary way to second engaging teeth 14 (better described below) which are part of first locking and unlocking means of the case 1.

The case 1 of the invention further comprises second locking and unlocking means 24, preferably connected to the side along its height 3 and projecting from its surface oriented towards the surface of the extension 6 in order to engage the first engaging teeth 7.

Preferably, the first locking and unlocking means 14 and/or the second locking and unlocking means 24 are made next to a side end 25 of the side 3; in a preferred way, the first locking and unlocking means 14 and the second locking and unlocking means 24 are made next to two opposite side ends 25, 26 of the side 3; preferably, the first locking and unlocking means 14 are arranged next to a first side end 25 of the side 3, and the second locking and unlocking means 24 are arranged next to a second side end 26 of the side 3, opposite to the first.

Advantageously, the first engaging teeth 7 are made as saw teeth, whose slanted side is oriented towards the angle enclosed by the sector of case 1. This enables a possible movement along the withdrawal direction of the extension 6 inside the sector of case 1, efficiently preventing their movement along the elongation direction of the side 3.

Figure 7:
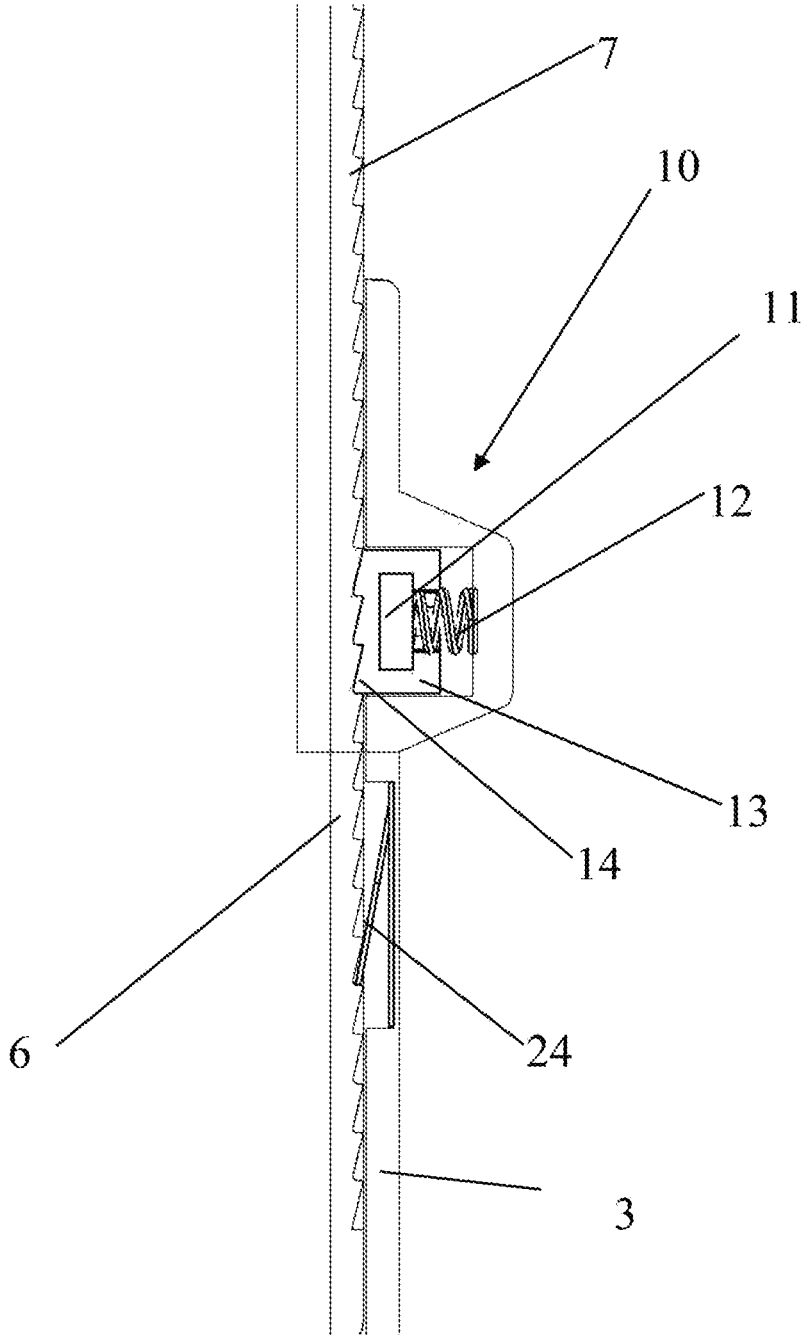
FIG. 7 is a side sectional view in detail of the locking and unlocking mechanism of the case in its locking position.

As clearly appears from what is described above, the case 1 according to the invention can be suited in a very accurate way to the sizes of an item 2 to be housed. The extension 6 and the sector of case 1 block the item 2 so that it cannot be withdrawn, unless by moving again the extension 6 along the elongation direction of the side 3. This is prevented by the second engaging teeth 14 and by the second locking and unlocking means 24, which unmovably engage the first engaging teeth 7, as shown in FIG. 7.

The sector of case 1 is deep enough to guarantee the application inside it of a magnetic or a radiofrequency label (not shown), which cannot be grasped from outside when the item 2 is housed in the case.

In order to guarantee the locking and unlocking of the case 1, the first engaging teeth 7 on the extension 6 are designed to be locked and unlocked by the first locking and unlocking means, in particular by the second engaging teeth 14, and by the second locking and unlocking means 24.

The second engaging teeth 14 are preferably obtained on a projection 13 inside which a transverse pin 11 made of ferromagnetic material is inserted, which is housed in an external appendix 10 of the side along its height 3, preferably made next to a side end of the side 3. The pin 11 is stressed always towards the extension 6 by first elastic means 12, for example a spring 12, which, by pushing pin 11 and projection 13, mutually engages the first 7 and the second 14 engagement teeth, as shown in FIG. 7.

The second locking and unlocking means 24 preferably comprise second elastic means 24 made of ferromagnetic material, for example at least one lamella 24, connected projecting to the side along its height 3, preferably fastened next to a side end of the side 3; in a preferred way, the second elastic means 24 comprise two lamellas 24, preferably fastened next to a side end of the side 3.

The second elastic means 24 are always stressed towards the extension 6 and mutually engaged with the first engaging teeth 7, as shown in FIG. 7.

Figure 8:
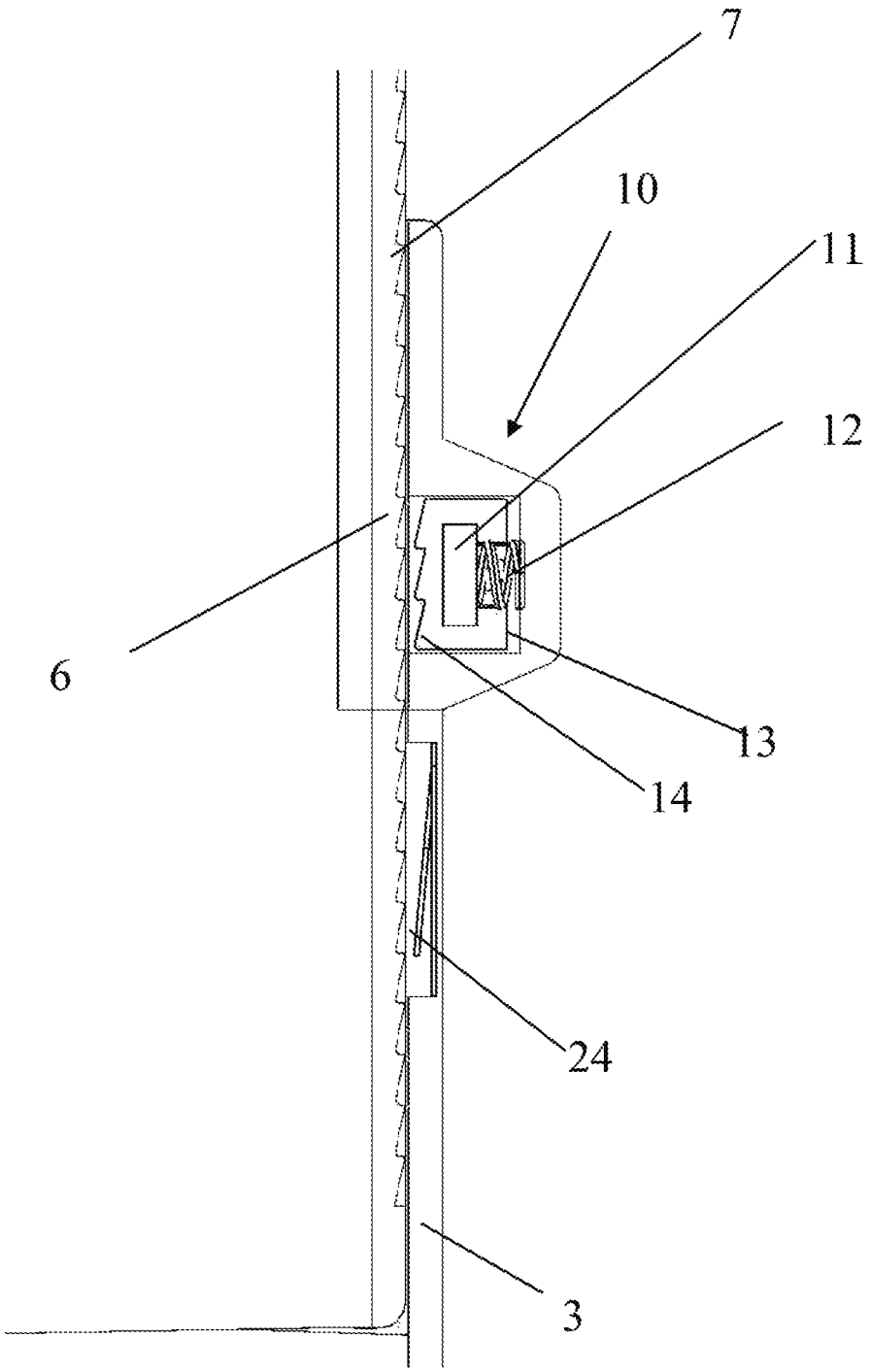
FIG. 8 is a side sectional view in detail of the locking and unlocking mechanism of the case in its unlocking position.

To unlock the extension 6, it is enough to subject the pin 11 and the second elastic means 24, preferably the lamella 24, to a magnetic attraction force along the withdrawal direction. This is shown in FIG. 8 with reference to the side 3. The pin 11 and the second elastic means 24 are in a withdrawn position in the appendix 10 and in the side 3 due to the action of a magnet (not shown), which is operatively contacted with the appendix 10 and with the second elastic means 24 and which exerts the necessary attraction force.

In this case, the operation of introducing and withdrawing an item 2 in the case 1 can be performed more comfortably. The magnet can be a fixed basement, with a housing hole (not shown) for the appendix 10. Therefore, it takes care of also easily keeping in position the case 1, allowing to more easily handle it, with the two hands substantially free, in particular for moving the extension 6.

Figure 1:
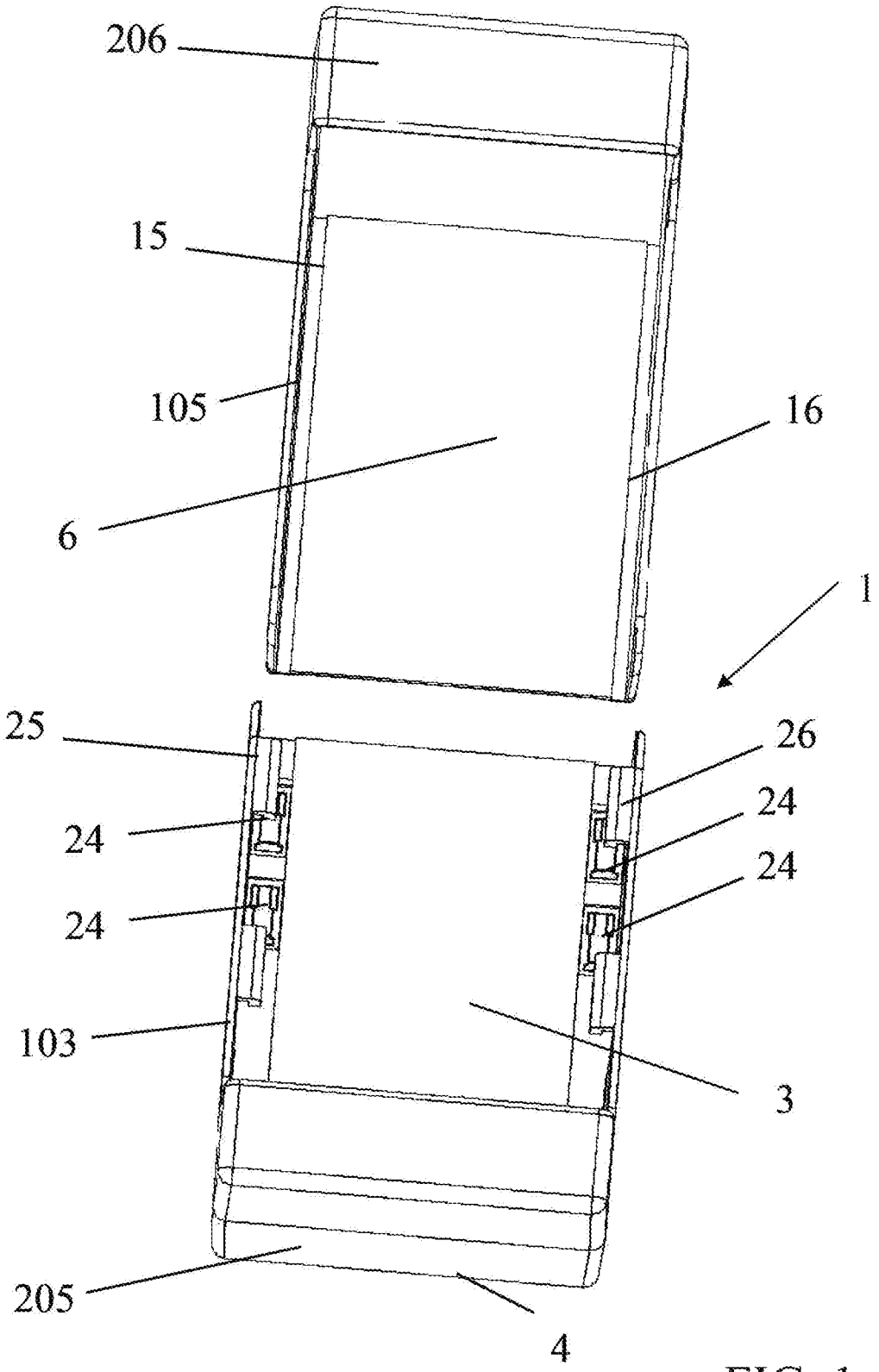
FIG. 1 is a front view which shows the two main parts of which the case is composed in a preferred embodiment of the invention.
Figure 2:
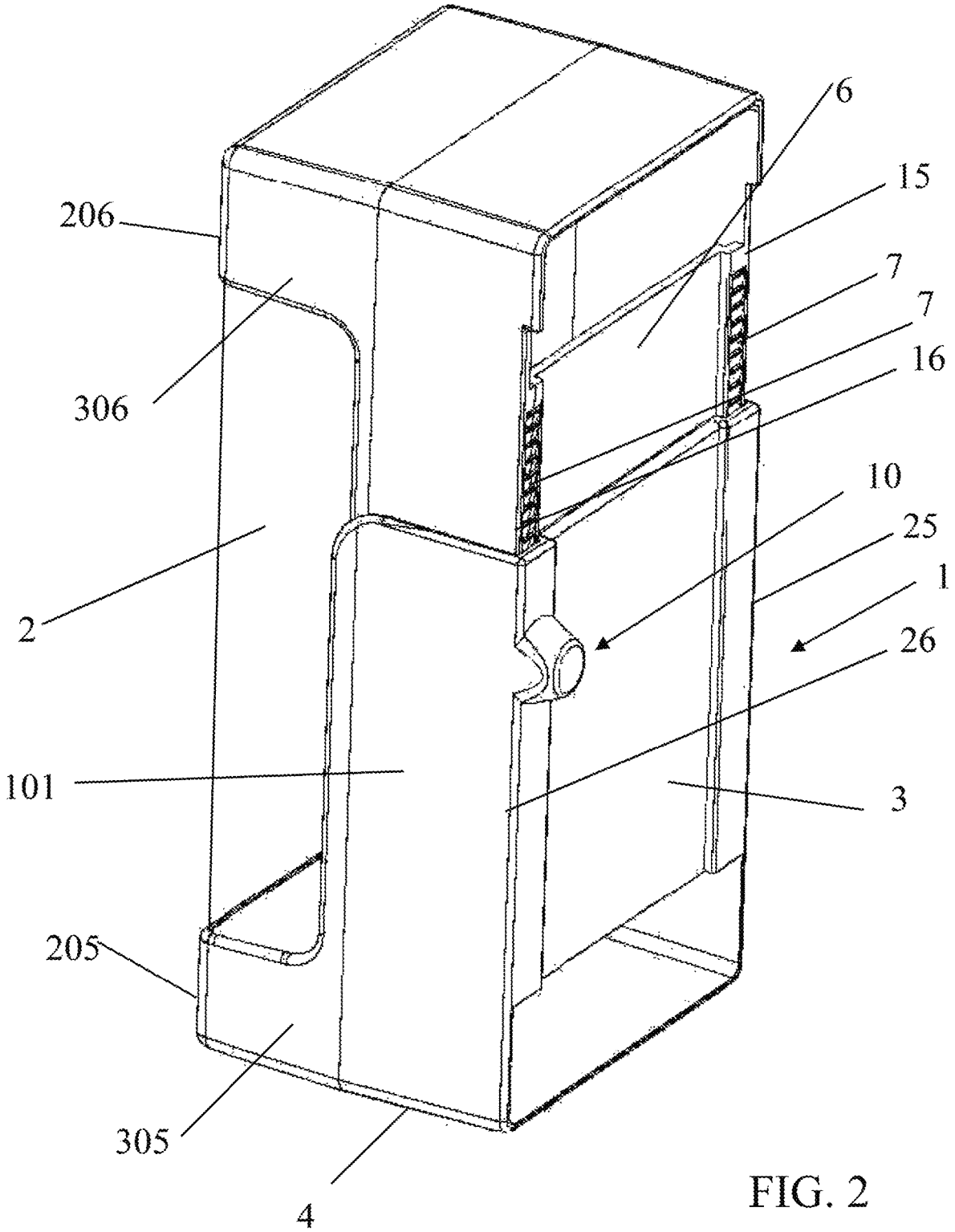
FIG. 2 is a rear perspective view of another embodiment of the anti-theft case according to the present invention.
Figure 9:
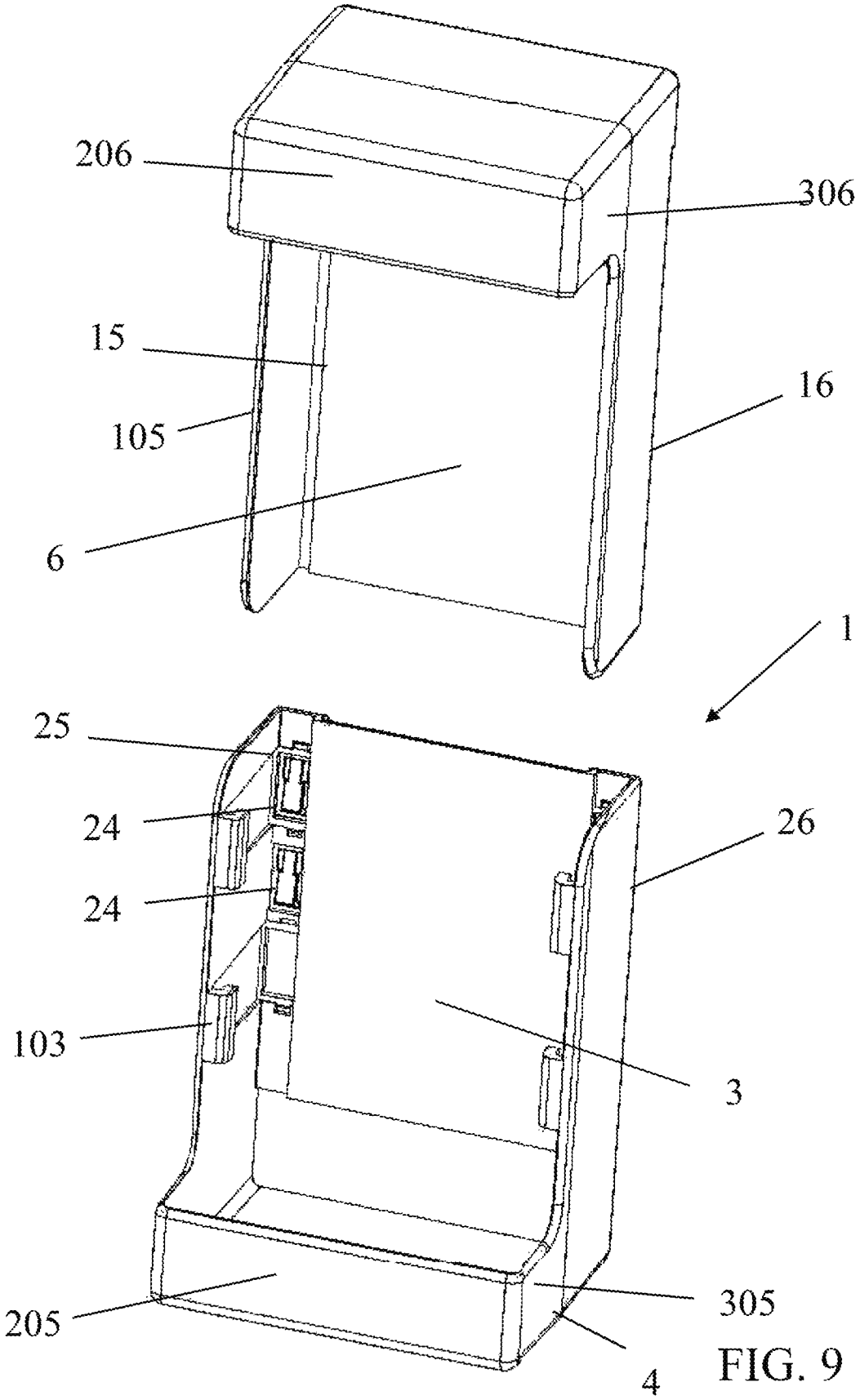
FIG. 9 is a front perspective view which shows the two main parts of which the case of the invention is composed, in an embodiment thereof.
Figure 10:
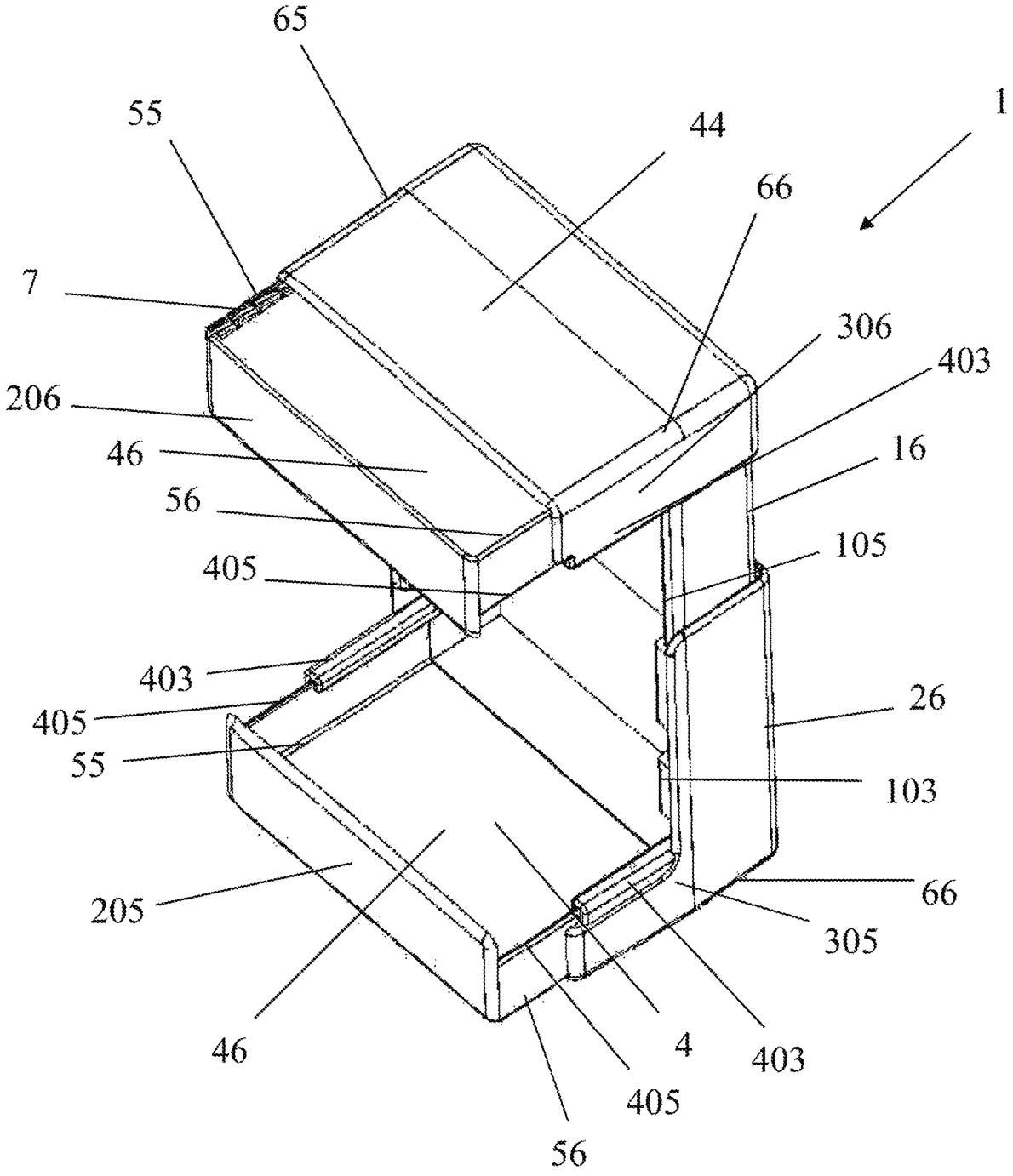
FIG. 10 is a rear perspective view which shows the two main parts of which the case of the invention is composed in a further embodiment thereof.

FIGS. 9, 10 and 1 show other embodiments of the adjustable anti-theft case 1 of the invention.

In the preferred embodiment of the invention shown in FIG. 9, the case 1 only comprises the second locking and unlocking means 24 arranged next to a side end 25 of the side 3, and a row of first engaging teeth 7 arranged next to a side end 15 of the extension 6, and does not provide for the first locking and unlocking means 14.

In the preferred embodiment of the invention shown in FIG. 1, the case 1 comprises second locking and unlocking means 24, preferably composed of at least one lamella 24, described previously, arranged both next to a first side end 25 of the side 3, and next to a second side end 26 of the side 3, opposite to the first; the case 1 further comprises two rows of first engaging teeth 7 arranged respectively next to a first side end 15 and a second side end 16 of the extension 6 opposite to the first, and does not provide for the first locking and unlocking means 14.

In another embodiment not shown in the Figures, the case 1 only comprises the first locking and unlocking means 14 arranged next to a side end 26 of the side 3, and a row of first engaging teeth 7 arranged next to a side end 16 of the extension 6, and does not provide for the second locking and unlocking means 24.

According to a further embodiment of the invention shown in FIG. 10, the case 1 comprises extensions 46 respectively assembled along the sides in depth 4, 44 sliding along their longitudinal direction. In particular, the extension 46 engages a profiled sliding extension 405, for example a dovetail, in a complementary guide 403 obtained on the end of the longitudinal side wall 305, 306. Preferably, the case 1 further comprises a sliding element on the extension 46 and a corresponding sliding element on the sides in depth 4, 44, not shown in the Figures, wherein such sliding elements are mutually engaged to guarantee the sliding of the extension 46 with respect to the sides in depth 4, 44.

In a similar way to the extension 6, the extension 46 is equipped, preferably on its face oriented towards the corresponding side along its depth 4, 44, with at least one row of first engaging teeth 7 arranged next to a side end 55 of the extension 46; in a preferred way, the extension 46 is equipped with two rows of first engaging teeth 7 arranged next to two opposite side ends 55, 56 of the extension 46;

preferably, a row of first engaging teeth 7 is arranged next to a first side end 55 of the extension 46, and a second row of first engaging teeth 7 is arranged next to a second side end 56 of the extension 46, opposite to the first, the rows of first engaging teeth 7 arranged next to a first side end 55 and a second side end 56 being in a preferred way mutually parallel. The first engaging teeth 7 of each row are made similarly to what has been previously described for the extension 6, and project over the surface of the extension 46 oriented towards the side along its depth 4, 44.

The case 1 according to this further embodiment of the invention comprises the first locking and unlocking means 14 and/or the second locking and unlocking means 24, preferably connected to the side along its depth 4, 44 and projecting from its surface oriented towards the surface of the extension 46 in order to engage the first engaging teeth 7.

Preferably, the first locking and unlocking means 14 and/or the second locking and unlocking means 24 are made next to a side end 65 of the side along its depth 4, 44; in a preferred way, the first locking and unlocking means 14 and the second locking and unlocking means 24 are made next to two opposite side ends 65, 66 of the side along its depth 4, 44; preferably, the case 1 comprises the first locking and unlocking means 14 arranged next to a first side end 65 and a second side end 66, opposite to the first, of the side along its depth 4, 44.

What is claimed is:

1. An adjustable anti-theft case of a type having means for preventing a removal of an item from inside the case, the case having a height and a depth and comprising:

a side element along its height and a depth element along its depth, the side element having a length substantially corresponding to or lower than a minimum item height and the depth element having a length substantially corresponding to or lower than a minimum item depth;

at least one of either the side element or the depth element being configured to elongate over a minimum elongation length;

wherein the element configured to elongate has a base portion and an extending portion configured to slide with respect to the base portion to an elongated condition;

further comprising an engagement element having a first set of first engaging teeth attached to one of the portions and first locking and unlocking means comprising ferromagnetic material attached to the other portion, the first locking and unlocking means projecting towards the first set of first engaging teeth, wherein the first locking and unlocking means is configured to engage with a portion of the first set of first engaging teeth when the case is in the elongated condition to lock the case in the elongated condition;

wherein the first locking and unlocking means further comprises second engaging teeth connected to a transverse pin made of ferromagnetic material, and an elastic means, wherein the pin and the second engaging teeth are biased towards the first set of first engaging teeth by the elastic means such that the second engaging teeth are pushed into mutual engagement with a portion of the first set of first engaging teeth, and wherein the pin is configured to be retracted by magnetic attraction force; and wherein the first locking and unlocking means further comprises a second elastic means made of ferromagnetic material, spaced apart from the second engaging teeth and configured and biased to engage another portion of the first set of first engaging teeth, and wherein the second elastic means is configured to be retracted by magnetic attraction force;

wherein the case is further designed to be unlocked and retracted from the elongated condition through disengagement between the first set of first engaging teeth and the first locking and unlocking means and between the second engaging teeth and the first locking and unlocking means by means of a magnetic attraction force; and wherein the case is configured to allow visibility of the item contained in the case.

2. The adjustable anti-theft case of claim 1, further comprising:

a second locking and unlocking means and a second set of first engaging teeth;

wherein the second locking and unlocking means is configured to engage with a portion of the second set of first engaging teeth; and wherein the second locking and unlocking means and the second set of first engaging teeth are spaced apart from the first locking and unlocking means and the first set of first engaging teeth.

3. The adjustable anti-theft case of claim 1, wherein the second elastic means comprises a first lamella.

4. The adjustable anti-theft case of claim 3, wherein the second elastic means further comprises a second lamella.

5. The adjustable anti-theft case of claim 1, wherein both the side element and the depth element are configured to elongate.

6. The adjustable anti-theft case of claim 5, wherein the side element and the depth element each comprise a base portion and an extending portion and wherein each extending portion is configured to slide with respect to its respective base portion.

7. The adjustable anti-theft case of claim 1, wherein, together with the item, the case houses, in an inaccessible position from outside, anti-theft means, comprising at least one of either a magnetic label or a radiofrequency emission label configured to cooperate with detecting barriers.

8. The adjustable anti-theft case of claim 1, wherein the extending portion has a "U"-shaped profile adjacent to a free end of the case, wherein the "U"-shaped profile is closed by a part of a transverse wall next to the free end, and wherein an end of the case opposite the free end includes and engagement seat for the item.

9. An adjustable anti-theft case of a type having means for preventing a removal of an item from inside the case, the case having a height and a depth and comprising:

a side element along its height and a depth element along its depth, the side element having a length substantially corresponding to or lower than a minimum item height and the depth element having a length corresponding to or lower than a minimum item depth;

wherein the side element is configured to elongate over a minimum side elongation length;

wherein the side element has a side element base portion and a side element extending portion configured to slide with respect to the side element base portion to an elongated side condition;

further comprising a side engagement element having a side set of first engaging teeth attached to one of the side element portions and a side locking and unlocking means comprising ferromagnetic material attached to the other side element portion, the side locking and unlocking means projecting towards the side set of first engaging teeth, wherein the side locking and unlocking means is configured to engage with a portion of the side set of first engaging teeth when the case is in the elongated side condition to lock the case in the elongated side condition;

wherein the case is further designed to be unlocked and retracted from the side elongated condition through disengagement between the side set of first engaging teeth and the side locking and unlocking means by means of a magnetic attraction force; and wherein the depth element is configured to elongate over a minimum depth elongation length;

wherein the depth element has a depth element base portion and a depth element extending portion configured to slide with respect to the depth element base portion to an elongated depth condition;

further comprising a depth engagement element having a depth set of first engaging teeth attached to one of the depth element portions and a depth locking and unlocking means comprising ferromagnetic material attached to the other depth element portion, the depth locking and unlocking means projecting towards the depth set of first engaging teeth, wherein the depth locking and unlocking means is configured to engage with a portion of the depth set of first engaging teeth when the case is in the elongated depth condition to lock the case in the elongated depth condition;

wherein the case is further designed to be unlocked and retracted from the elongated depth condition through disengagement between the depth set of first engaging teeth and the depth locking and unlocking means by means of a magnetic attraction force.

10. The adjustable anti-theft case of claim 9, wherein the side locking and unlocking means further comprises side second engaging teeth connected to a side transverse pin made of ferromagnetic material, and a side elastic means, wherein the side pin and the side second engaging teeth are biased towards the side set of first engaging teeth by the side elastic means such that the side second engaging teeth are pushed into mutual engagement with a portion of the side set of first engaging teeth, and wherein the side pin is configured to be retracted by the magnetic attraction force.

11. The adjustable anti-theft case of claim 10, wherein the depth locking and unlocking means further comprises depth second engaging teeth connected to a depth transverse pin made of ferromagnetic material, and a depth elastic means, wherein the depth pin and the depth second engaging teeth are biased towards the depth set of first engaging teeth by the depth elastic means such that the depth second engaging teeth are pushed into mutual engagement with a portion of the depth set of first engaging teeth, and wherein the depth pin is configured to be retracted by the magnetic attraction force.

12. The adjustable anti-theft case of claim 11, wherein the depth locking and unlocking means further comprises a depth second elastic means made of ferromagnetic material, spaced apart from the depth second engaging teeth and configured and biased to engage another portion of the depth set of first engaging teeth, and wherein the second depth elastic means is configured to be retracted by a magnetic attraction force.

13. The adjustable anti-theft case of claim 12, wherein the second depth elastic means comprises a lamella.

14. The adjustable anti-theft case of claim 10, wherein the side locking and unlocking means further comprises a side second elastic means made of ferromagnetic material, spaced apart from the side second engaging teeth and configured and biased to engage another portion of the side set of first engaging teeth, and wherein the second side elastic means is configured to be retracted by a magnetic attraction force.

15. The adjustable anti-theft case of claim 14, wherein the second side elastic means comprises a lamella.

* * * * *